US010201737B2

(12) United States Patent
Nernberger

(10) Patent No.: US 10,201,737 B2
(45) Date of Patent: Feb. 12, 2019

(54) CURLING BROOM HEAD AND REMOVABLE HANDLE ATTACHMENT

(71) Applicant: Kroy Everett Nernberger, Madison, WI (US)

(72) Inventor: Kroy Everett Nernberger, Madison, WI (US)

( * ) Notice: Subject to any disclaimer, the term of this patent is extended or adjusted under 35 U.S.C. 154(b) by 253 days.

(21) Appl. No.: 15/081,012

(22) Filed: Mar. 25, 2016

(65) Prior Publication Data

US 2017/0274260 A1 Sep. 28, 2017

(51) Int. Cl.
*A63B 67/14* (2006.01)

(52) U.S. Cl.
CPC ..... *A63B 67/148* (2013.01); *A63B 2209/10* (2013.01); *A63B 2210/50* (2013.01)

(58) Field of Classification Search
None
See application file for complete search history.

(56) References Cited

U.S. PATENT DOCUMENTS

| | | | | |
|---|---|---|---|---|
| 4,475,262 | A * | 10/1984 | Downer | A46B 7/06 15/144.2 |
| 6,687,943 | B2 * | 2/2004 | Zorzo | A47L 13/254 15/147.1 |
| 9,198,503 | B1 * | 12/2015 | Rieger | A46B 11/00 |
| 2017/0215564 | A1 * | 8/2017 | Sande | A46B 7/042 |

FOREIGN PATENT DOCUMENTS

| | | |
|---|---|---|
| CA | 2 297 466 A1 | 7/2001 |
| CA | 2 758 718 A1 | 5/2013 |
| CA | 2 767 883 A1 | 8/2013 |

* cited by examiner

*Primary Examiner* — Sarah B McPartlin
(74) *Attorney, Agent, or Firm* — Patterson Thuente Pedersen, P.A.

(57) ABSTRACT

The curling broom head is composed of a fabric section, flexible section, lower body, upper body, and a stem or stem assembly that is used to attach the broom head to the broom handle. The fabric section is a stand-alone piece of fabric that can easily be removed and replaced by the user. The fabric section is wrapped around the flexible section and lower body and is secured into place and ready for game play when the lower body is attached to the upper body. At any time, the curling fabric may be easily replaced by separating the upper and lower bodies, removing the old fabric from the lower body and replacing it with new fabric.

The curling broom handle is an elongated member that is attached to the broom head on one end. A removable device(s) is attached or secured to the broom handle at a desired height and provide an easier profile to grip and/or extra surface area to exert downward force. A removable device is attached or secured to the end of the broom handle to provide an increased surface area to exert downward force on the broom handle.

6 Claims, 9 Drawing Sheets

CURLING BROOM HEAD AND REMOVABLE HANDLE ATTACHMENT

BACKGROUND

Curling brooms are used in the sport of curling to slightly alter the trajectory of a curling stone to the benefit of the team/player that is sweeping. Modern curling brooms are generally composed of two main parts: a handle and a head. Most curling broom heads have a fabric layer that contacts the ice surface, a flexible layer above the fabric, a rigid section(s) above the flexible layer and a stem that attaches to the rigid section(s) to the broom handle. The handle is generally tubular in shape and is gripped by the curler to move the broom in a side to side motion on the ice, in front of the path of the curling stone.

The sweeping action can have different levels of effectiveness depending on the downward force that is applied to the broom head, the velocity of the broom head, and the type and condition of fabric. Each player has a different sweeping force and velocity that stays fairly constant from game to game, so those two factors stay generally constant. The broom head, however, will diminish in effectiveness the more it is used. This is due to several factors including fraying, coating wear and dirt buildup. In order to maintain maximum sweeping effectiveness, it is ideal to replace the fabric section of the broom head as often as possible.

The majority of broom heads are assembled in such a way that when the fabric section is worn, the flexible layer and rigid section must also be discarded and replaced, because the fabric section is permanently secured to the rigid section by staples, with the flexible layer sandwiched in between. This method of assembly causes a very high amount of unnecessary waste, because the rigid section and flexible layer could be reused if the fabric wasn't stapled to the rigid section. There are other types of broom heads where only the fabric layer can be replaced when worn, however those broom heads have fabric layers with secondary production processes associated with them, such as stitching two or more fabric sections together or adding parts to the fabric to allow fastening to the rest of the broom head. These processes add cost to the broom head, which is passed on to the curler every time the broom head fabric needs replacement. A broom head that has a removable fabric section with a very minimal secondary production process, will have a lower replacement cost, and cause less unnecessary waste.

The sweeping technique varies greatly from one curler to another, and each player differs in size, strength and sweeping ability. Generally, the more downward force a curler can apply to the broom, the more effective they will be at sweeping. Although most curling brooms handles have approximately the same shape, some handles are manufactured with key design features to enable the curler to apply more downward force. Common design features include a material on the outside surface of the broom handle that is somewhat sticky, making it easier for the curler to grip the broom and apply more force. Although the intent of the grip material is to provide better sweeping effectiveness, depending on the sweeping technique of the curler, the sticky surface may impede their efforts by creating extra friction on their clothing or skin. Because the grip material is permanently affixed to the broom handle, those people that don't want the feature, must choose a different broom handle that doesn't have it, sometimes also giving up other benefits such as lighter broom handle weight. As such, a need exists for removable broom handle attachments that, when attached to the broom handle, allow the curler to exert more downward force on the broom head.

BRIEF SUMMARY OF THE INVENTION

In one aspect, the curling broom comprises a broom handle and broom head. The broom handle is gripped by the curler during the sweeping motion and is attached to the broom head at one end. The broom head is composed of an upper body, lower body, a flexible section, and a fabric section. A rigid stem or pivoting stem assembly is attached the broom head for connection to the broom handle. When assembled, the fabric section is located at the bottom of the broom head and is in contact with the ice surface during the sweeping action. The broom head is assembled by placing the flexible section between the fabric and lower body and wrapping the fabric around the other two sections, partially securing the fabric to the lower body, then securing the lower body to the upper body, making the fabric section securely attached to the broom head. The fabric section remains secured to the broom head until the upper and lower bodies are separated.

In another aspect, the curling broom comprises a broom handle and broom head. The broom handle is gripped by the curler during the sweeping motion and is attached to the broom head at one end. A removable grip device is attached or secured to the outside of the broom handle at the desired distance from the broom head, to allow the curler to more easily apply downward force to the broom handle and broom head. A removable broom handle end is attached or secured to the end of the broom handle, opposite the broom head, where the broom handle end has a significantly increased surface area as compared to the cross-sectional area of the broom handle, allowing the curler to more comfortably exert a downward force on the broom handle end by having the force spread out over a larger surface area.

DETAILED DESCRIPTION OF THE INVENTION

Figure 1:
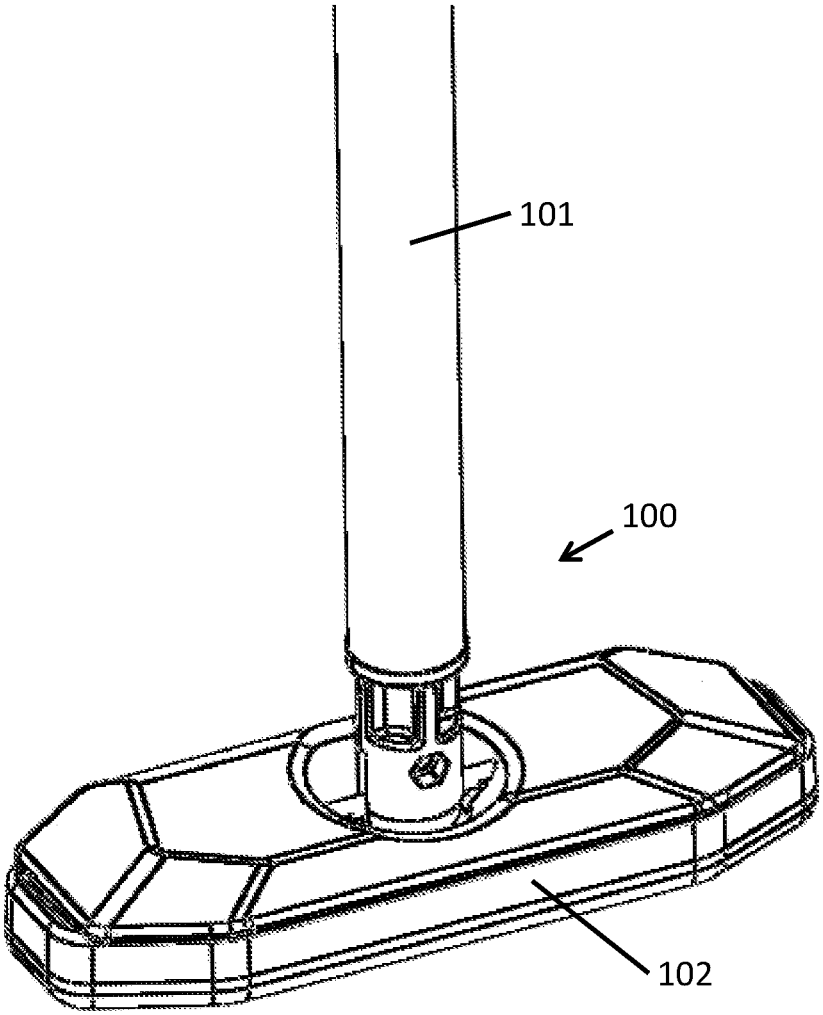
FIG. 1 is a perspective view of a curling broom head assembly attached to a broom handle
Figure 2:
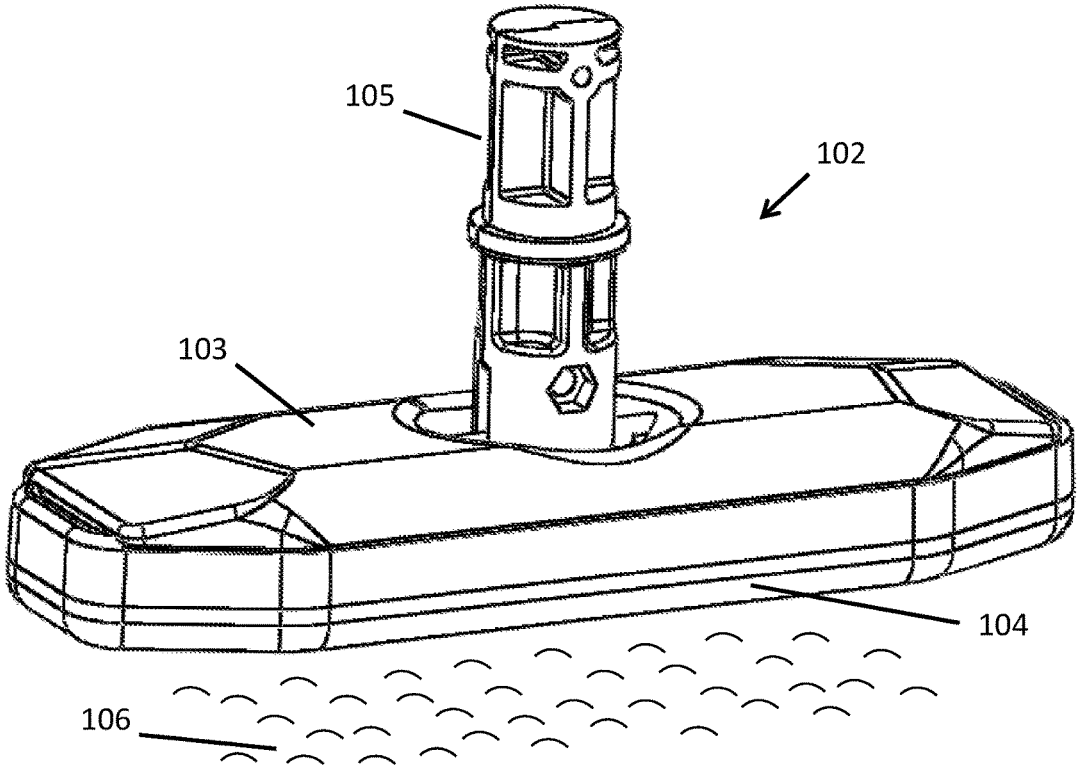
FIG. 2 is a perspective view of a broom head assembly

FIG. 1 shows the lower portion of a complete curling broom 100 that includes a broom handle 101 and a broom head assembly 102. The broom head assembly 102 is attached to the broom handle 101 at one end of the broom handle 101. FIG. 2 shows a broom head assembly 102 that includes an upper body 103, bottom assembly 104 and stem section 105. The stem section 105 is attached to the broom handle 101 when the curling broom 100 is properly assembled. During the sweeping motion, the bottom of the bottom assembly 104 is in contact with the curling ice 106 with the upper body 103 of the broom head 102 orientated above the bottom assembly 104 and the broom handle 101 orientated above the broom head assembly 102. As used herein, direction and/or orientation terms such as lower, upper, bottom and top refer to the upright orientation of the broom handle 101 and broom head assembly 102 as illustrated in FIG. 1 and FIG. 2.

Figure 3:
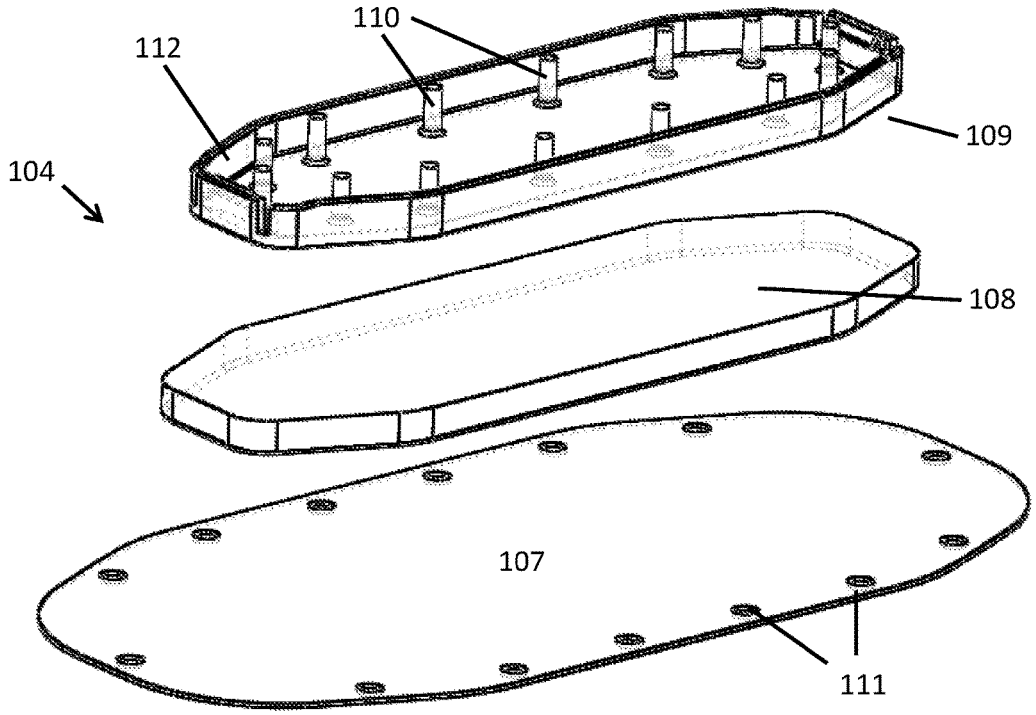
FIG. 3 is an exploded view of the bottom assembly of a curling broom head
Figure 4:
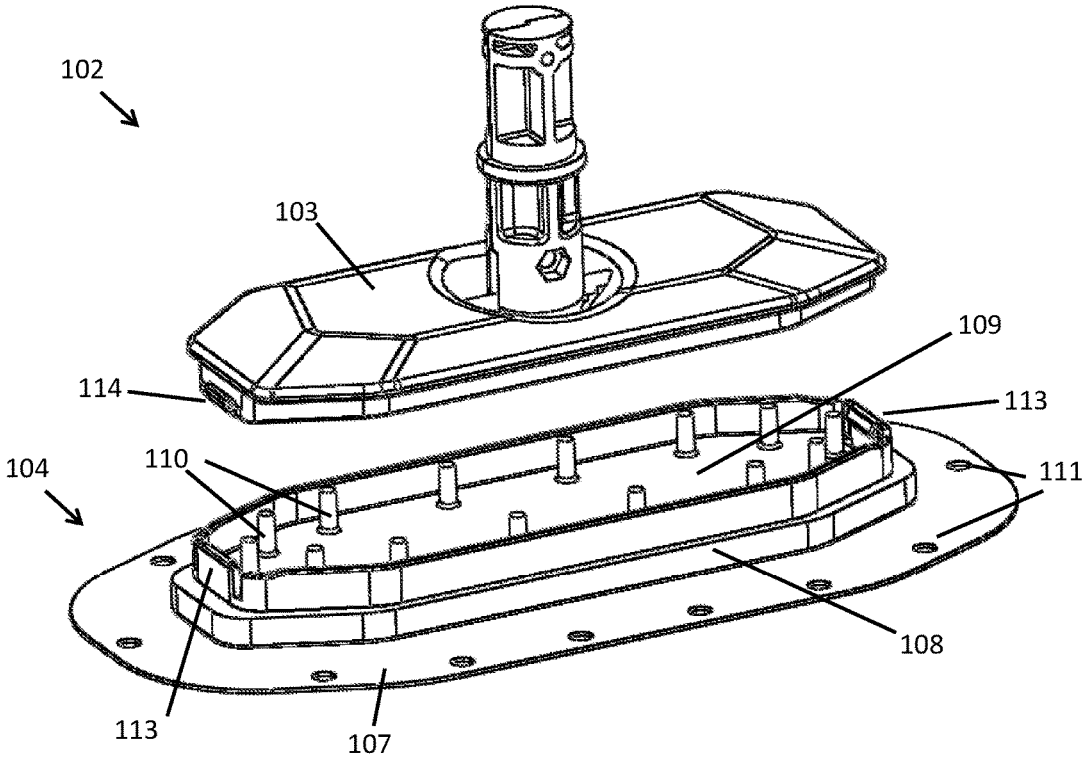
FIG. 4 is a perspective view of the stacked order of the bottom assembly parts, before assembly
Figure 5:
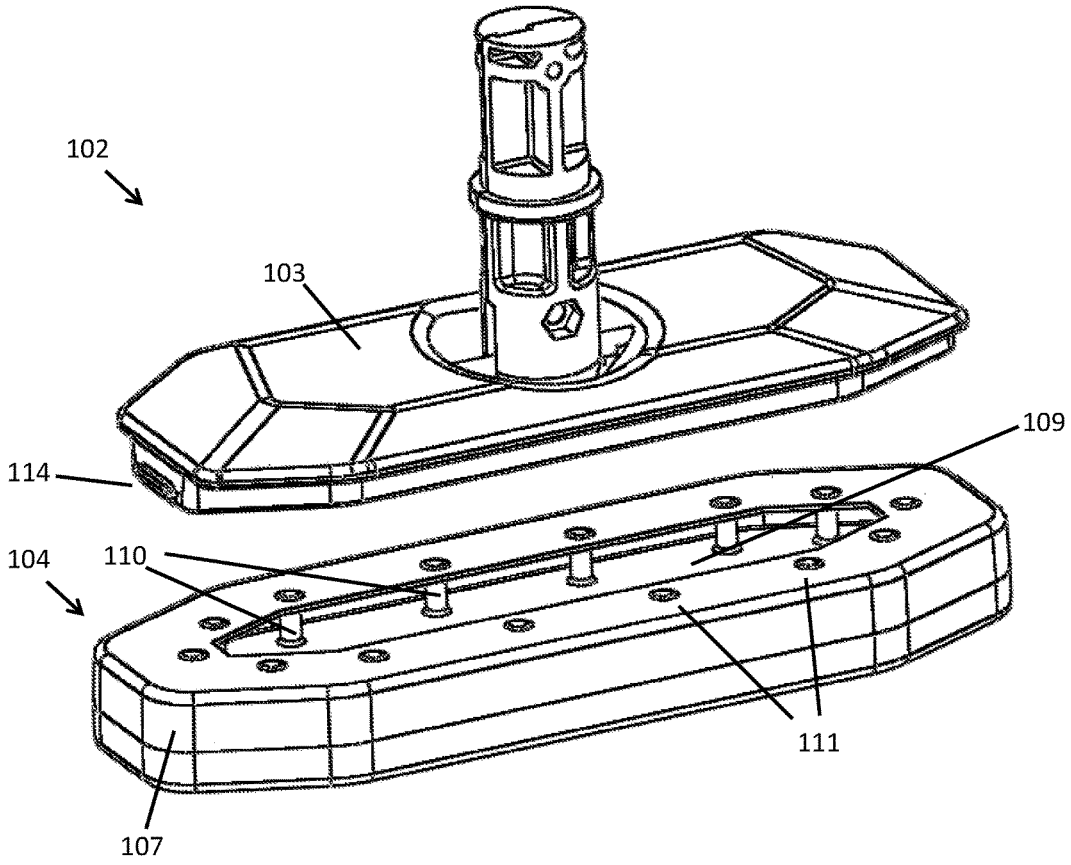
FIG. 5 is a perspective view of the assembled bottom assembly, before attachment to the upper body

With reference to FIG. 3, the bottom assembly 104 consists of a fabric section 107, a flexible section 108 and lower body 109. In this embodiment, the lower body 109 contains pins 110 that are used to mate with the holes 111 in the fabric section 107 when the bottom assembly 104 is assembled. The lower body 109 also contains a wall 112 around the perimeter to tighten the fabric section 107 and secure it to the pins 110 during assembly of the broom head assembly 102. With reference to FIG. 4 and FIG. 5, during assembly of the bottom assembly 104, the flexible layer 108 is placed between the fabric section 107 and lower body 109 and the fabric section 107 is wrapped around the flexible section 108 and lower body 109 and the holes 111 in the fabric section 107 are placed over the corresponding pins 110 on the top of the lower body 109. While the illustrated embodiment uses pins 110 and holes 111 to secure the fabric section 107 to the lower body 109, other means, such as hook and loop material, tape or any other suitable method, may be used without departing from the scope of this invention.

Still referring to FIG. 4 and FIG. 5, the fabric section 107 is secured into place during the assembly of the broom head assembly 102 when the lower body 109 is secured to the upper body 103. Fastening features 113 are located on the lower body 109 to secure it to the fastening features 114 of the upper body 103 when the broom head assembly 102 is assembled. It is understood that any other type of fastening feature can be used to secure the bottom assembly 104 to the upper body 103, such as bolts, pins, or any other suitable means, without departing from the scope of this invention.

Figure 6:
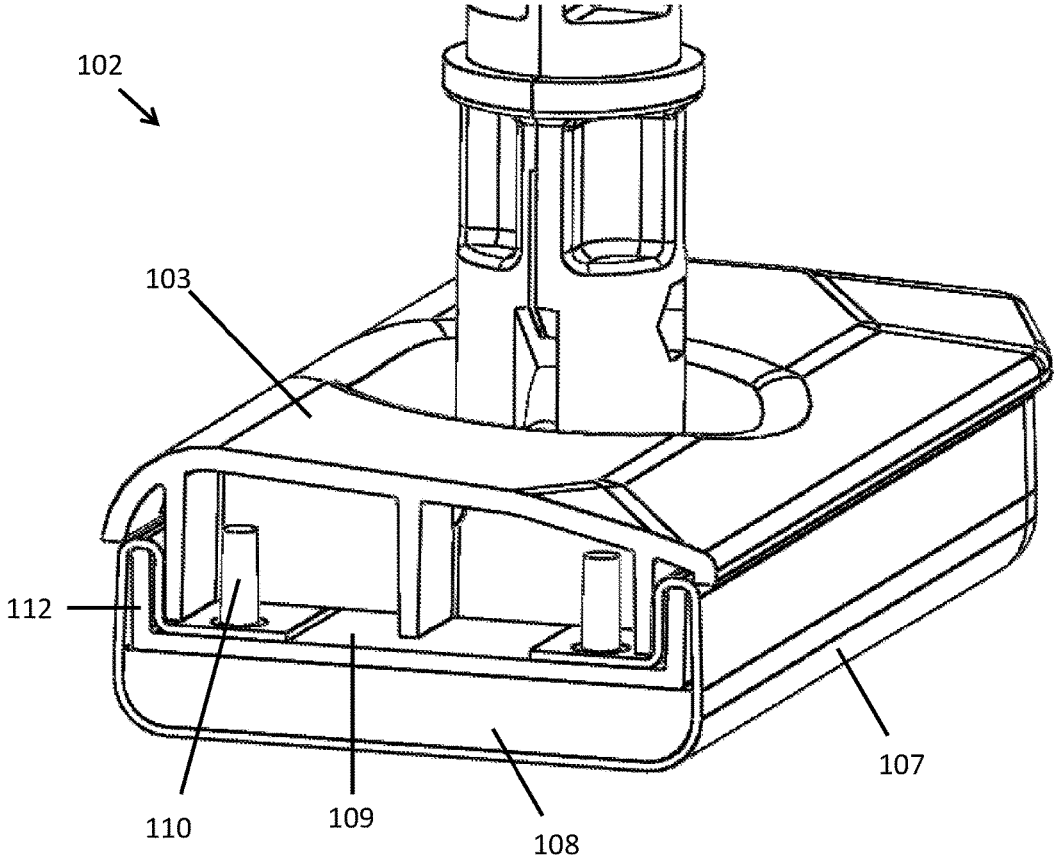
FIG. 6 is a cross-section view of an assembled broom head assembly

FIG. 6 shows a cross-section view of the assembled broom head assembly 102. When the lower body 109 is secured to the upper body 103, the fabric section 107 is pushed to the bases of the pins 110 of the lower body 109, causing the fabric section 107 to tighten and form around the wall 112 of the lower body 109 and compress the flexible section 108. The fabric section 107 cannot be removed from the broom head assembly 102 until the lower body 109 is separated from the upper body 103.

Figure 7:
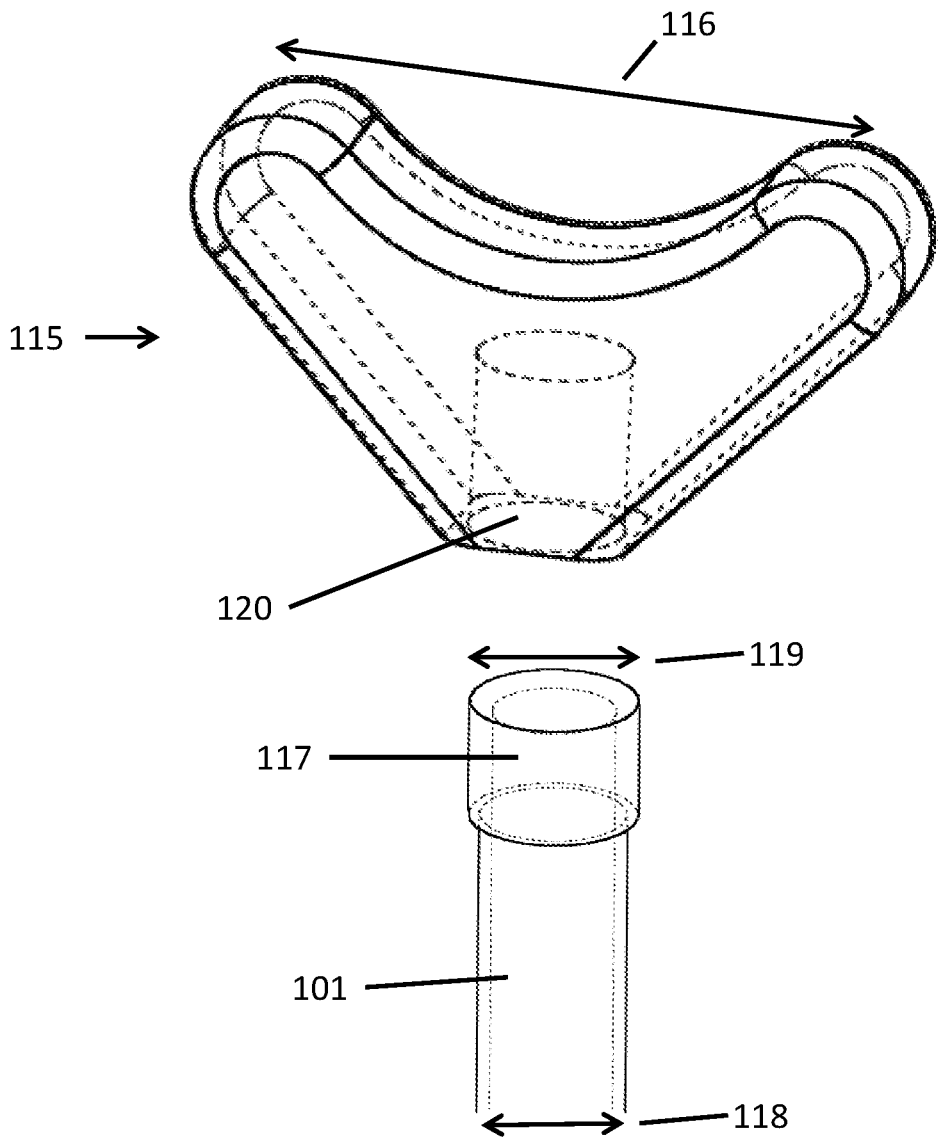
FIG. 7 is a perspective view of a removable broom handle attachment that attaches to the end of the curling broom

FIG. 7 shows one embodiment of a removable curling broom handle attachment 115 that attaches to the end of the broom handle 101. The broom handle 101 has an end cap 117 that is secured to the end of the broom handle 101. The bottom surface of the curling broom attachment 115 has a profile 120 that allows the broom handle attachment 115 to fit around the end cap 117 and secure to the broom handle 101. The broom handle 101 has a cross-sectional dimension 118, and the end cap 117 has a cross-sectional dimension 119. The maximum cross-sectional dimension 116, of the curling broom attachment 115, in the plane parallel to dimensions 118 and 119, is at least twice the size of dimensions 118 and 119 to allow the curler to more comfortably apply force to the top of the broom handle attachment 115 during the sweeping motion. Although this embodiment shows an end cap 117 on the broom handle 101, it is understood that a curling broom attachment 115 can be secured to a broom handle 101 that does not have an end cap 117, without departing from the scope of this invention. Similarly, while this embodiment shows one method of securing the removable curling broom attachment 115 to the curling broom 101, it is understood that other means of securing the curling broom attachment 115 to the curling broom 101 may be used without departing from the scope of this invention.

Figure 8:
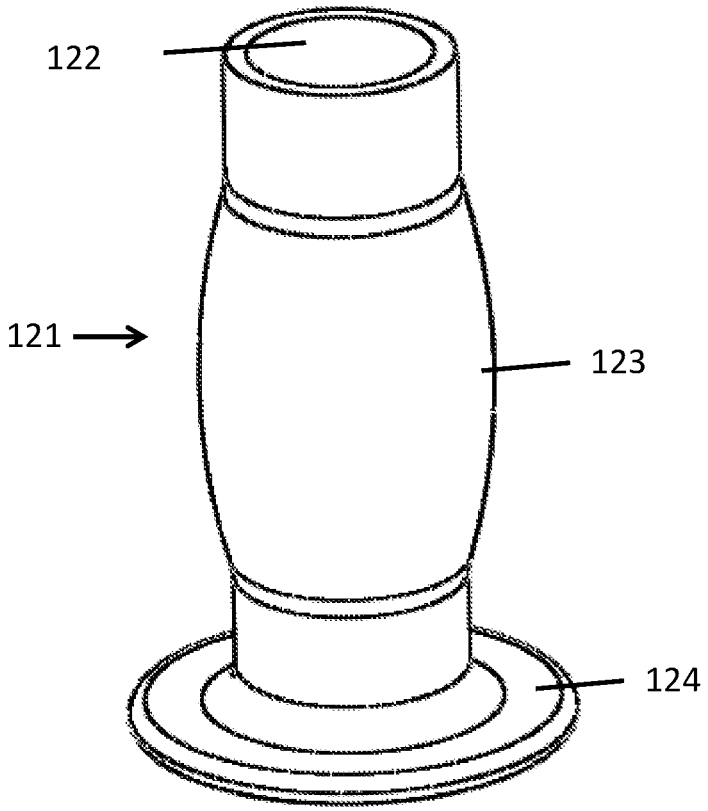
FIG. 8 is a perspective view of a removable broom handle attachment that attaches along the length of the curling broom

FIG. 8 shows another embodiment of a removable curling broom handle attachment 121 that can be secured to any area along the length of the broom handle 101. The broom handle attachment 121 has an inside wall 122 that has the same shape as, or is flexible and can take the shape of the broom handle 101. The inside wall 122 has surface properties that allow it to grip the broom handle 101 and not slip when downward pressure is applied to the broom handle attachment 121. The outside of the broom handle attachment 121 has a surface 123 for the palm of the hand and a surface 124 that allows the curler to more easily apply downward force on the broom handle. Although in this embodiment, the broom handle attachment is one piece that slides onto the broom handle, it is understood that other designs, profiles or constructions may be used, such as a 2-piece design that clamps onto the broom handle 101, without departing from the scope of this invention.

Figure 9:
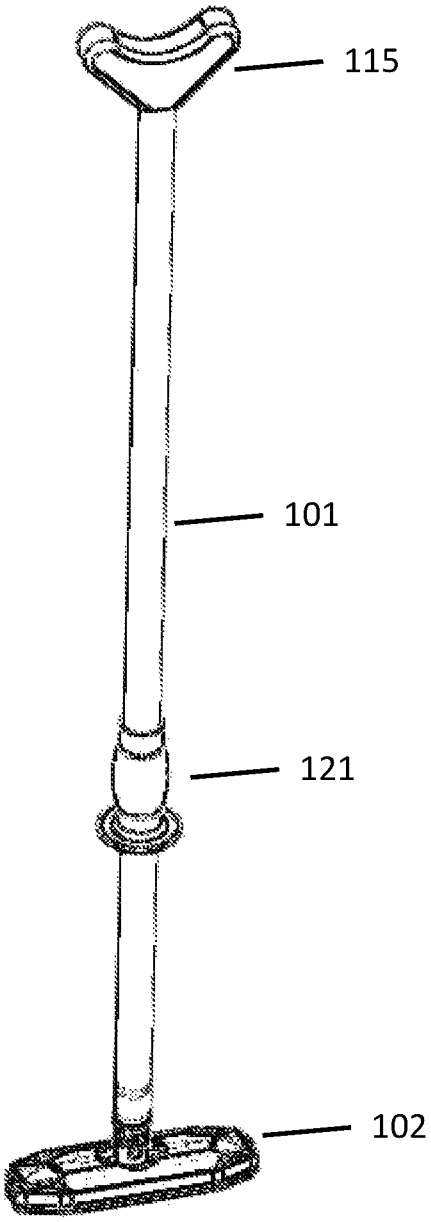
FIG. 9 is a perspective view of a curling broom with 2 embodiments of removable broom handle attachments attached to the handle

FIG. 9 shows one embodiment of a curling broom that is composed of a broom handle 101, with a broom head assembly 102 at one end, an embodiment of a removable broom handle attachment 115 at the other end, and another embodiment of a removable broom handle attachment 121 secured on a section along the length of the broom handle 101.

The invention claimed is:

1. A curling broom head comprising:
- a top section; and
- a removable pad assembly coupleable to the top section, the removable pad assembly including:
  - a rigid section having a top portion and a bottom portion, the rigid section further including:
    - a peripheral wall extending upward from the bottom portion,
    - one or more top section engagement members configured to be coupleable to the top section, and
    - one or more fabric engagement members arranged on the top portion of the rigid section wherein at least one of the fabric engagement members terminate prior to the top section,
  - a compressible pad section arranged below the rigid section, and
  - a fabric section arranged below the compressible pad and configured to wrap over the peripheral wall of the rigid section and couple to the top portion of the rigid section at the one or more fabric engagement members.

2. The curling broom head set forth in claim 1 wherein the one or more fabric engagement members comprise vertical pins and the fabric section has matching holes for mating with the pins of the rigid section.

3. A curling broom comprising:
- a curling broom handle; and
- a curling broom head coupled to an end of the curling broom handle, the curling broom head further comprising:
  - a top section; and a removable pad assembly coupleable to the top section, the removable pad assembly including:

a rigid section having a top portion and a bottom portion, the rigid section further including:

a peripheral wall extending upward from the bottom portion, one or more top section engagement members configured to be coupleable to the top section, and one or more fabric engagement members arranged on the top portion of the rigid section wherein at least one of the fabric engagement members terminate prior to the top section, a compressible pad section arranged below the rigid section, and a fabric section arranged below the compressible pad and configured to wrap over the peripheral wall of the rigid section and couple to the top portion of the rigid section at the one or more fabric engagement members.

4. The curling broom set forth in claim 3 where the fabric section has holes disposed about a perimeter of the fabric section, the holes configured to couple to the fabric engagement members of the rigid section.

5. A method for attaching a fabric section to a curling broom head wherein the curling broom head includes a top section, compressible pad section, a fabric section and a rigid section, and the rigid section including a peripheral wall, one or more fabric engagement members that terminate prior to the top section and one or more top section engagement members, the method comprising:

wrapping the fabric section around the compressible pad section and over the peripheral wall of the rigid section;

coupling the fabric section to the rigid section at the one or more fabric engagement members; and securing the rigid section to the top section by coupling the top section engagement members of the rigid section to the top section.

6. The method of claim 5, wherein the one or more fabric engagement members comprise vertical pins and the fabric section has corresponding holes for mating with the pins of the rigid section.

* * * * *